United States Patent [19]

Krisay

[11] 3,986,285

[45] Oct. 19, 1976

[54] DETACHABLE TOP SIDE MOUNT

[76] Inventor: Robert J. Krisay, 108 Lehigh St., Johnstown, Pa. 15905

[22] Filed: May 16, 1975

[21] Appl. No.: 578,163

[52] U.S. Cl. ..... 42/1 ST; 33/248

[51] Int. Cl.[2] ..... F41G 1/38

[58] Field of Search ..... 42/1 ST; 33/245, 247, 33/248

[56] References Cited

UNITED STATES PATENTS

| | | | |
|---|---|---|---|
| 1,190,121 | 7/1916 | Critchett | 33/245 |
| 2,368,954 | 2/1945 | Weaver | 33/245 |
| 2,653,386 | 9/1953 | Winton | 33/248 |
| 3,724,800 | 4/1973 | Rubin et al. | 33/247 |
| 3,834,052 | 9/1974 | Steck | 42/1 ST |
| 3,835,565 | 9/1974 | Weast | 42/1 ST |
| 3,922,794 | 12/1975 | Ackerman, Jr. | 33/248 |

*Primary Examiner*—Charles T. Jordan
*Attorney, Agent, or Firm*—Clarence A. O'Brien; Harvey B. Jacobson

[57] ABSTRACT

A detachable top side mount for mounting a telescope on a rifle has a bracket provided with holes arranged for adjustably connecting the bracket to the side of a receiver of a rifle. Provided on a portion of the bracket associated with the top of the rifle is a base arranged for removably mounting conventional scope top mount rings on the bracket. The base is provided with a plurality of pairs of transverse slots selectively receiving keys on the mount rings for affording eye-relief to a shooter.

8 Claims, 3 Drawing Figures

DETACHABLE TOP SIDE MOUNT

BACKGROUND OF THE INVENTION

1. Field of the Invention

This invention relates generally to a telescope mount for rifles, and particularly to a side mount to which conventional scope mount rings may be detachably connected.

2. Description of the Prior Art

Most rifles are constructed so as to permit attachment of a telescope to the rifle as by standard, or conventional, detachable top mount rings such as those manufactured by Weaver, Tasco, Swift, Universal Co., and the like. These conventional top mount rings generally are provided with a shank, or shaft, which extends transverse of the ring in order to connect together jaws of a clamping arrangement provided on the ring. This shank is so arranged as to function as a key in a cooperating keyway formed by a slot arranged transversely of a rifle on which the ring is mounted and assure positive retention of the mount ring on the rifle.

A problem arises, however, with many types of rifles, and particularly those generally referred to as carbines which have a shell ejection port on an upper portion of the rifle generally referred to as the "receiver." With these rifles, and some others, it is necessary to mount the telescope on what is usually the left side of the receiver looking away from the shooter, or from the stock to the muzzle of the rifle. U.S. Pat. No. 1,835,576, issued Dec. 8, 1931 to R. Sparr, shows an example of a telescope mount attachable to the side, as opposed to the top, of the barrel of a rifle so as to provide clearance for shells to be ejected from the rifle past the telescope arranged above the rifle, or to properly anchor the telescope to the rifle when insufficient space is provided on the top portion of the receiver and/or barrel for properly mounting a telescope. U.S. Pat. Nos. 1,198,665, issued Sept. 19, 1916 to A. B. Rolfe-Martin, 1,704,060, issued Mar. 5, 1929 to R. G. Packard, Jr., and 1,816,195, issued July 28, 1931 to J. H. Redfield, disclose additional examples of telescope mounting rings attachable to the side of a rifle.

The known telescope side mounts, however, are limited in their applications inasmuch as they do not provide the requisite adjustability, rigidity, and adaptability to conventional scope mount rings as is required by most shooters. Further, the lack of adaptability of the known telescope side mounts requires a shooter to make an unnecessary investment in scope mounting equipment inasmuch as the shooter's conventional top mount rings cannot be employed with the known side mounts. Nor do the known side mounts provide for the eye-relief which is so important to a shooter.

SUMMARY OF THE INVENTION

It is an object of the present invention to provide a telescope mounting rifle side mount which will permit the use of conventional top mount rings.

It is another object of the present invention to provide a telescope mounting rifle side mount which will afford eye-relief to users of the mount.

It is yet another object of the present invention to provide a detachable top side mount for mounting a telescope on a rifle which permits adjustment of the mount, and hence the telescope, relative to the rifle in order to obtain proper windage setting of the telescope.

These and other objects are provided by providing a detachable top side mount having: a bracket provided with an attachment arrangement permitting the bracket to be adjustably connected on the side of a rifle; and a base provided on a portion of the bracket associated with the top of the rifle for removably mounting conventional top mount rings on the bracket.

The bracket is preferably a substantially rectangular plate extending longitudinally along a fore-and-aft orientation of an associated rifle, and the bracket is attached to the rifle by an arrangement including a hole provided in the plate and arranged for receiving a take-down screw, a pair of openings provided in the plate and arranged for receiving a pair of receiver screws, and a pair of apertures provided in the plate and arranged for receiving a pair of windage adjusting screws.

The base advantageously includes a pair of like longitudinally extending flat-faced coplanar, spaced seating ribs forming a channel therebetween and provided with a pair of transverse slots for receiving keys associated with the mount rings. Preferably, there are two pairs of seating ribs arranged longitudinally spaced from one another, and divided into sets arranged at opposite longitudinal ends of the base, for permitting eye-relief of a telescope mounted on the mount rings.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
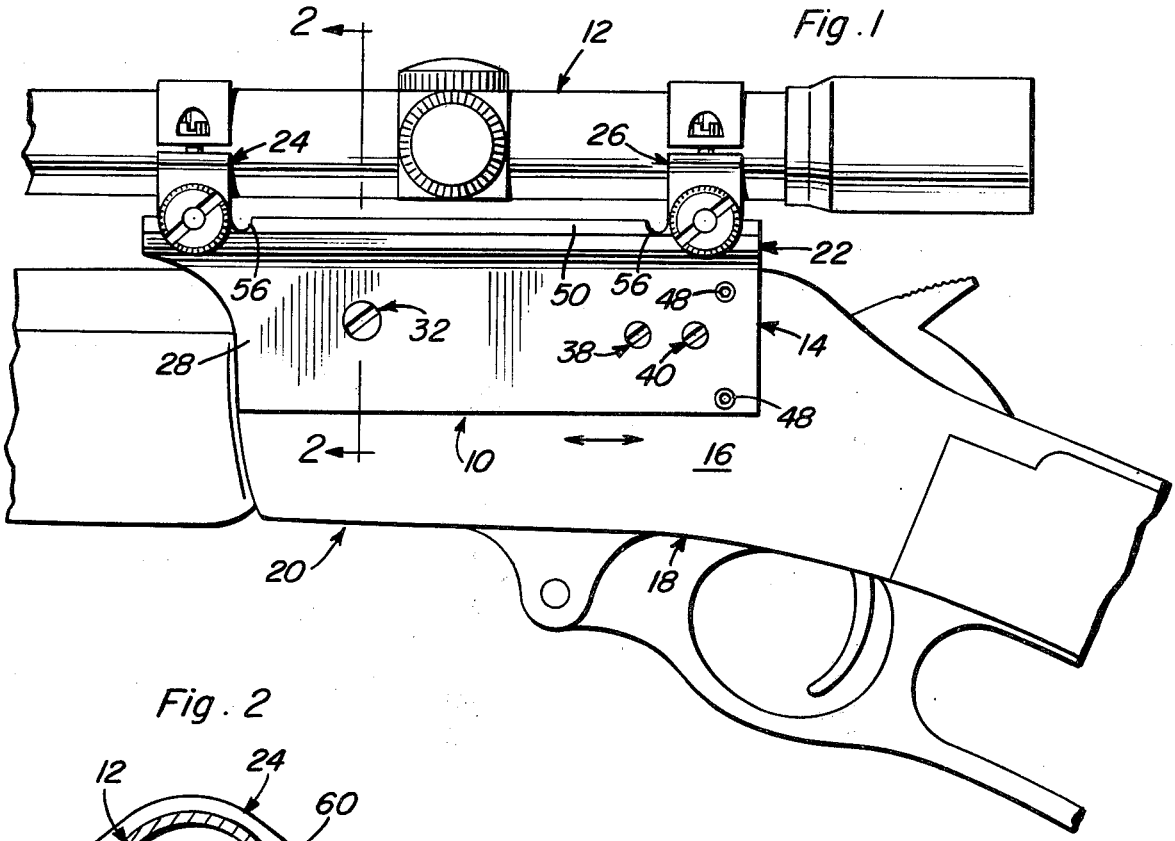
FIG. 1 is a fragmentary, side elevational view showing a detachable top side mount according to the present invention mounting a telescope on a rifle.
Figure 2:
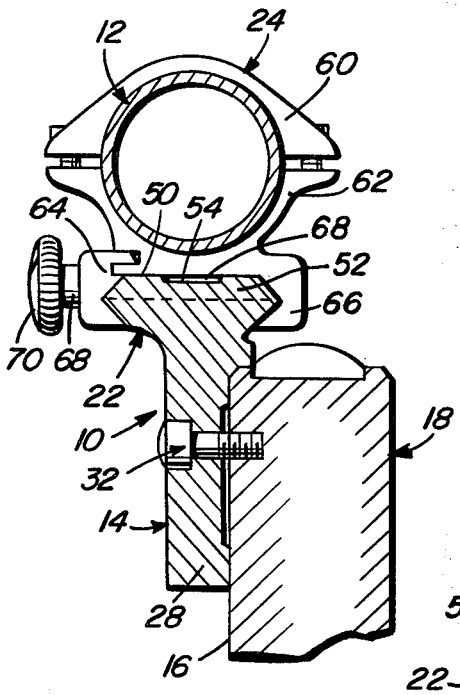
FIG. 2 is a fragmentary, sectional view taken generally along the line 2—2 of FIG. 1.

Referring now to FIGS. 1 and 2 of the drawings, a detachable top side mount 10 according to the present invention for mounting a telescope 12 on a rifle has a bracket 14 provided with an attachment arrangement, to be described in greater detail below, for adjustably connecting bracket 14 on the, for example, left side 16 of a receiver 18 of a rifle 20. As illustrated, rifle 20 may be a Winchester Model 94 and the like. A base 22 is provided on a portion of bracket 14 associated with the top of rifle 20 for removably mounting conventional scope mounting rings 24 and 26 on bracket 14. The construction of the rings 24, 26 with which mount 10 is intended to be used will be described below.

Bracket 14 is advantageously a substantially rectangular plate 28 having a configuration in cross section such as to facilitate attachment of plate 28 to a receiver 18 so that plate 28 will extend longitudinally along a fore-and-aft orientation of, for example, rifle 20. This fore-and-aft orientation is indicated by the double arrow in FIG. 1.

Figure 3:
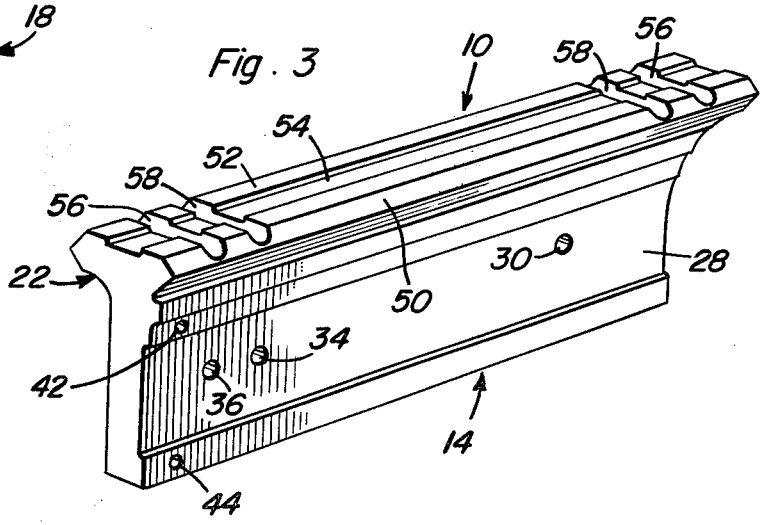
FIG. 3 is a perspective view showing a detachable top side mount according to the present invention from the side looking from the right in FIG. 2 of the drawings.

Plate 28 is provided with an attachment arrangement which includes a hole 30 provided in plate 28 in the forward, or fore, portion of plate 28 for receiving a take-down screw 32 (FIG. 2) which threadingly engages a hole provided in left side 16 of receiver 18. It will be appreciated that although receiver 18 is illustrated in section in FIG. 2 as being solid, this is for reasons of simplicity only, and it will be understood that the conventional construction of the interior of receiver 18 has been omitted. The attachment arrangement associated with plate 28 also includes a pair of openings 34 and 36 provided in plate 28 and arranged for receiving a pair of receiver screws 38 and 40 (FIG. 1). Finally, the attachment arrangement includes a pair of apertures 42 and 44 also provided in plate 28 and arranged for receiving a pair of windage adjusting screws 48 (FIG. 1). As can be seen from FIGS. 1 and 3 of the drawings, openings 34, 36 and apertures 42, 44 are arranged at the rearward, or aft, portion of bracket 14 relative to the fore-and-aft direction of the rifle 20, with openings 34, 36 being arranged spaced from one another along the fore-and-aft direction, and apertures 42, 44 being arranged spaced from one another along a line perpendicular to the fore-and-aft direction.

While windage screws 48 are advantageously provided with nylon tips so as to press against left side 16 of receiver 18, receiver sight screws 38 and 40 will also be threaded into threaded bores (not shown) provided in receiver 18. In order to adjust base 22, and therefore telescope 12, for windage, the receiver sight screws 38 and 40 are first loosened and then windage adjustment screws 48 are tightened, or vice versa. Then receiver sight screws 38 and 40 are re-tightened in order to hold bracket 14 in the desired position. The screws counteract each other, and hold bracket 14, and therefore base 22, away from side 16 of receiver 18 of rifle 20.

Base 22 includes a pair of like longitudinally extending flat-faced coplanar, spaced seating ribs 50 and 52 forming a channel 54 between them and provided with, for example, two pairs of transverse slots 56 and 58 for receiving keys associated with rings 24 and 26 and anchoring the rings 24, 26 on base 22. The two pairs of slots 56 and 58, which are advantageously arranged in the illustrated manner with a slot 56, 58 arranged at each longitudinally spaced end of base 22, permit eye-relief of telescope 12 by permitting the position of telescope 12 to be readily adjusted.

Referring again to FIG. 2 of the drawings, it can be readily seen that ring 24, with ring 26 being identical, has a two-piece ring, composed of pieces 60 and 62 adjustably connected together as by the illustrated screw fasteners, with piece 62 having associated therewith a movable jaw 64 and a fixed jaw 66. The illustrated rings 24, 26 are of the construction used in the Weaver-Detachable Mounts manufactured by the Weaver Company. Extending between jaws 64 and 66 is a shank 68 fixed to which is a handwheel 70. In a known manner, rotation of handwheel 70 causes shank 68 to move moveable jaw 64 toward and away from fixed jaw 66 in order to clamp and unclamp ring 24, 26 from base 22. Most importantly, shank 68 will fit into a selected one of the slots 56 and 58 in order to cooperate with the slot in the manner of a key and keyway to positively anchor the ring 24, 26 on base 22. Further, as mentioned above, the illustrated arrangement of slots 56 and 58 affords the desired eye-relief by permitting placement of rings 24, 26 in different positions in slots 56, 58 for each rifleman's needs, regardless of turret position of rings 24, 26 on scope 12. Thus, proper eye-relief can be achieved while providing a key and keyway arrangement for preventing forward and rearward motion of scope 12 relative to rifle 20.

As can be appreciated from the above description and from the drawings, mount 10 provides a simple, rugged, and reliable manner of mounting a telescope onto a rifle requiring a side mount while permitting the use of conventional scope mount rings attachable to the side mount with proper eye-relief. Further, it will be appreciated that side mount 10 may also be employed with rifles permitting the direct attachment of top mount rings, but where it is desired to position the scope to one side of the barrel of the rifle in order to permit use of the rifle's open sights.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A detachable top side mount for mounting a telescope on a rifle, the mount comprising, in combination:

a. a bracket provided with attachment means for adjustably connecting the bracket on the side of a receiver of a rifle; and b. base means provided on a portion of the bracket associated with the top of the rifle for removably mounting conventional scope top mount rings on the bracket, the base means including a pair of like longitudinally extending flat-faced coplanar, spaced seating ribs forming a channel therebetween and provided with a pair of transverse slots for receiving keys provided on the mount rings, there being two pairs of slots arranged longitudinally spaced from one another at spaced longitudinal ends of the base for permitting eye-relief of a telescope mounted on the mount rings.

2. A detachable top side mount for mounting a telescope on a rifle, the mount comprising, in combination:

a. a bracket provided with attachment means for adjustably connecting the bracket on the side of a receiver of a rifle; and b. base means provided on a portion of the bracket associated with the top of the rifle for removably mounting conventional scope top mount rings on the bracket, the bracket being a substantially rectangular plate extending longitudinally along a fore-and-aft orientation of the associated rifle, and the attachment means includes a hole provided in the plate and arranged for receiving a take-down screw, a pair of openings provided on the plate spaced from the hole and arranged for receiving a pair of receiver sight screws, and a pair of apertures provided in the plate adjacent the pair of openings and arranged for receiving a pair of windage adjusting screws.

3. A structure as defined in claim 2, in combination with a rifle having a receiver, and with a take-down screw, two receiver sight screws, and two windage adjusting screws, the take-down screw associated with the hole provided in the plate and with an associated screw-thread bore provided in the receiver of the rifle, the take-down screw being anchored in the screw-threaded bore, the two receiver sight screws being arranged in the openings provided in the plate, a pair of screw-threaded further bores provided in the receiver and associated with the openings provided in the plate for threadingly receiving the receiver sight screws, and the windage adjusting screws being threadingly engaged in the apertures and abutting the side of the receiver for providing a bias against the receiver, the bracket being adjusted relative to the side of the receiver by loosening the receiver sight screws, adjusting the windage adjusting screws, and re-tightening the receiver sight screws.

4. A structure as defined in claim 2, wherein the base means includes a pair of like longitudinally extending flat-faced coplanar, spaced seating ribs forming a channel therebetween and provided with a pair of transverse slots for receiving keys provided on the mount rings.

5. A structure as defined in claim 4, wherein there are two pairs of slots arranged longitudinally spaced from one another at spaced longitudinal ends of the base for permitting eye-relief of a telescope mounted on the mount rings.

6. A structure as defined in claim 4, in combination with a rifle having a receiver, and with a take-down screw, two receiver sight screws, and two windage adjusting screws, the take-down screw associated with the hole provided in the plate and with an associated screw-thread bore provided in the receiver of the rifle, the take-down screw being anchored in the screw-threaded bore, the two receiver sight screws being arranged in the openings provided in the plate, a pair of screw-threaded further bores provided in the receiver and associated with the openings provided in the plate for threadingly receiving the receiver sight screws, and the windage adjusting screws being threadingly engaged in the apertures and abutting the side of the receiver for providing a bias against the receiver, the bracket being adjusted relative to the side of the receiver by loosening the receiver sight screws, adjusting the windage adjusting screws, and re-tightening the receiver sight screws.

7. A structure as defined in claim 3, wherein the base means includes a pair of like longitudinally extending flat-faced coplanar, spaced seating ribs forming a channel therebetween and provided with a pair of transverse slots arranged for receiving keys provided on the mount rings.

8. A structure as defined in claim 7, wherein there are two pairs of slots arranged longitudinally spaced from one another at spaced longitudinal ends of the base for permitting eye-relief of a telescope mounted on the mount rings.

* * * * *